US011066857B2

(12) United States Patent
Torkowski et al.

(10) Patent No.: US 11,066,857 B2
(45) Date of Patent: Jul. 20, 2021

(54) MOTOR VEHICLE HANDLE

(71) Applicants: Thorsten Torkowski, Essen (DE); Andreas Koch, Heiligenhaus (DE)

(72) Inventors: Thorsten Torkowski, Essen (DE); Andreas Koch, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 629 days.

(21) Appl. No.: 15/860,364

(22) Filed: Jan. 2, 2018

(65) Prior Publication Data

US 2018/0216373 A1 Aug. 2, 2018

(30) Foreign Application Priority Data

Jan. 27, 2017 (DE) ..... 10 2017 101 654.6

(51) Int. Cl.

| | |
|---|---|
| ***E05B 79/06*** | (2014.01) |
| ***E05B 81/30*** | (2014.01) |
| ***E05B 81/56*** | (2014.01) |
| ***E05B 81/64*** | (2014.01) |
| ***E05B 81/42*** | (2014.01) |
| ***E05B 85/10*** | (2014.01) |
| ***E05B 85/18*** | (2014.01) |

(52) U.S. Cl.

CPC ..... *E05B 85/18* (2013.01); *E05B 79/06* (2013.01); *E05B 81/30* (2013.01); *E05B 81/42* (2013.01);

(Continued)

(58) Field of Classification Search

CPC ..... E05B 85/18; E05B 85/10; E05B 85/103; E05B 85/107; E05B 85/14; E05B 79/06;

(Continued)

(56) References Cited

U.S. PATENT DOCUMENTS 9,062,478 B2 * 6/2015 Bingle ..... E05B 85/107
10,301,854 B2 * 5/2019 Christensen ..... E05B 85/107

(Continued)

FOREIGN PATENT DOCUMENTS

DE 10 2013 112 706 A1 5/2015
DE 10 2015 119 170 A1 9/2016

(Continued)

OTHER PUBLICATIONS

European Search Report of European Patent Application No. 17205116 dated May 16, 2018, 7 pages.

*Primary Examiner* — Alyson M Merlino
(74) *Attorney, Agent, or Firm* — Fay Sharpe LLP

(57) ABSTRACT

A motor vehicle actuation device includes a functional element supported on a carrier housing for rotation about a rotational axis and movement between a standby position and an operating position, a drive device disposed on the carrier housing, and a control element in a drive connection with the drive device, which is designed to move the functional element from the standby position into the operating position when the drive device is activated. The control element is moved from a home position into a final actuation position via an initial actuation position when the drive device is activated. The control element forces the functional element from the standby position into the operating position when it moves from the home position into the initial actuation position. The control element retains the functional element in the operating position when it moves from the initial actuation position into the final actuation position.

10 Claims, 6 Drawing Sheets

(52) U.S. Cl.
CPC ..... *E05B 81/56* (2013.01); *E05B 81/64* (2013.01); *E05B 85/103* (2013.01); *E05B 85/107* (2013.01)

(58) Field of Classification Search
CPC ..... E05B 81/30; E05B 81/42; E05B 81/56; E05B 81/64; Y10T 292/57
See application file for complete search history.

(56) References Cited

U.S. PATENT DOCUMENTS

| | | | | |
|---|---|---|---|---|
| 2011/0127780 | A1* | 6/2011 | Barth | E05B 81/68 292/213 |
| 2014/0132012 | A1* | 5/2014 | Yoshino | E05B 85/103 292/336.3 |
| 2016/0281397 | A1 | 9/2016 | Park et al. | |
| 2018/0058113 | A1* | 3/2018 | Han | E05B 85/107 |
| 2018/0171686 | A1* | 6/2018 | Couto Maquieira | E05B 85/103 |
| 2018/0252009 | A1* | 9/2018 | Porada | E05B 85/107 |

FOREIGN PATENT DOCUMENTS

| | | | | |
|---|---|---|---|---|
| DE | 102015115673 | A1 * | 3/2017 | E05B 85/103 |
| DE | 102017107229 | A1 * | 10/2018 | E05B 85/107 |
| EP | 3255231 | A1 * | 12/2017 | E05B 85/107 |
| FR | 2798156 | A1 * | 3/2001 | E05B 77/30 |
| FR | 3023865 | A1 * | 1/2016 | E05B 85/107 |
| WO | WO 2016/200743 | A1 | 12/2016 | |

* cited by examiner

MOTOR VEHICLE HANDLE

BACKGROUND

The invention relates to a motor vehicle actuation device that has a carrier housing that can be attached to a motor vehicle, a functional element, which is rotatably supported about a rotational axis on the carrier housing, and can be moved between a standby position and an operating position, a drive device disposed on the carrier housing, and a control element, configured to move the functional element from the standby position to the operating position when the drive device is activated.

A motor vehicle actuation device of the type described above is known, for example, from DE 10 2013 112 706 A1. A control element designed as a lever is connected in a drive connection to a drive device. The drive device moves when the control element is activated, wherein the control element itself is moveably coupled to a functional element in the form of a door handle. As a result of the movement of the control element caused by the drive device, the door handle is extended away from the body of the motor vehicle. The control element, in the form of a lever, is moved thereby away from the drive device until the lever, or the control element, bears on a stop and cannot be moved further. Consequently, the stop guarantees that the door handle is moved to an exact position away from the body. Noises of the lever against the stop, and a so-called blocking course of the drive device, which protects against the danger of an overload, or even damage, to the drive device, are accepted, having a negative effect on the satisfaction with the performance and service life of the motor vehicle actuation device. Such motor vehicle actuation devices are known not only for door handles, but also for other components on motor vehicles that can be extended, e.g. rear view cameras, which are extended in the manner described above from the outer contour or body of the motor vehicle, which have the same disadvantages with regard to satisfaction with the performance and service life. In other motor vehicle actuation devices, which do not have a stop, the precision of the positioning of the functional element is not ensured, because it cannot be ensured that the functional element will always be moved to exactly the same position because of the constantly changing gearing lag.

The invention therefore addresses the problem of creating an improved motor vehicle actuation device with a simple construction, which enables a precise positioning of a functional element of a motor vehicle, while at the same time providing a high level of satisfaction with the performance, and an increased service life.

BRIEF SUMMARY

With a motor vehicle actuation device of the type specified in the introduction, the problem is solved according to the invention in that the control element moves from a home position to a final actuation position via an initial actuation position when the drive device is activated, wherein the control element forces the functional element from the standby position into the operating position when it moves from the home position to the initial actuation position, and wherein the control element retains the functional element in the operating position when it moves from the initial actuation position into the final actuation position.

Advantageous and practical designs and refinements of the invention can be derived from the dependent claims.

The invention shall provide a motor vehicle actuation device that is distinguished by a functional structure and has a compact and inexpensive construction. In accordance with the invention, the functional element is disposed in its operating position once the control element is located between the initial actuation position and the final actuation position. The control element, moved by the drive device, consequently continues to move, regardless of whether the functional element is already in its operating position and retained there by the control element. In this manner, the functional element can be positioned precisely, even if the drive device is not yet deactivated. This is beneficial, particularly with electrically operated drive devices, because there is always a certain amount of lag in the gearing, which caused major problems for precise positioning of the functional element in the prior art, because the control element did not always ensure the desired, and in particular identical, movement or deflection of the functional element, due to the gearing lag of the control element. This disadvantage is resolved with the invention, because the functional element remains in its operating position, even when the control element continues to move. The area between the initial actuation position to the final actuation position thus corresponds to an area in which the control element continues to move, but this movement does not cause further movement of the functional element away from of the operating position. In accordance with the invention, a lag of the gearing in the drive device is thus allowed for, wherein the gearing lag exerts no influence on the position of the functional element. Moreover, stops are not needed in the motor vehicle actuation device according to the invention for stopping the movement of the control element or the functional element, when the functional element has reached its desired operating position. Consequently, the noises caused by the stop, which have an adverse effect on the satisfaction of the user with the performance of the device, are eliminated. Stops for limiting movement are thus made superfluous by the invention, such that components can be eliminated, and production costs reduced. Because the motor vehicle actuation device according to the invention does not need any stops for delimiting movement, the drive device also does not have the problem caused by blocking the current, such that a driver stage of the drive device does not become overheated, which would otherwise result a reduction in the service life due to overload, or could even lead to damage to the drive device.

The design of the invention provides that the control element has a drive shaft in a drive connection with the drive device, on which an actuation projection is formed, extending radially away from the drive shaft, which interacts with the functional element when the control element is moved into the initial actuation position, and forces the functional element out of the standby position into the operating position. The actuation projection takes the form of a cam, for example, wherein the cam has a base diameter that corresponds to the diameter of the drive shaft, and a cam lift for the interaction with the functional element, which is greater than the base diameter. The actuation projection is thus formed as a section of the drive shaft in the form of an irregular circumference, and represents a structurally inexpensive option.

It is particularly advantageous when the actuation projection is formed with two radius line sections and an arc section, seen in an axial perspective, wherein the control element moves from its home position to the initial actuation position via an engagement position when the drive device is activated, wherein the control element moves from its home position to the initial actuation position via an engagement position when the drive device is activated, wherein the actuation projection is disposed at a distance to contact point formed on the functional element offset to the rotational axis, without coming in contact therewith, in the home position, and wherein one of the two radius line sections of the actuation projection bears on the contact point formed on the functional element offset to the rotational axis in the engagement position. The arc-shaped design of the actuation projection of the control element offers a structurally clever option for continuously moving the functional element from its standby position toward its operating position with the help of the radius line section.

The invention provides in another design that the arc section of the actuation projection bears on the contact point in the initial actuation position. It is of particular advantage thereby when the arc section of the actuation projection bears on the contact point when the control element moves from its initial actuation position to its final actuation position when activated. As a result, the arc section retains the functional element in its operating position with its constant radius, even when the control element continues to move, wherein the movement is a rotational movement. As long as the arc section of the actuation projection bears on the defined contact point of the functional element, the functional element remains in its operating position. With an appropriate length of the arc section, the gearing lag of the drive device thus has no effect on the movement and positioning of the functional element, because the functional element is retained in its operating position.

In order to determine the position of the control element, in order to stop the drive device, and thus stop the movement of the control element, it is provided in the design of the invention that a trigger projection is formed on the drive shaft, offset on the circumference thereof to the actuation projection, which actuates a button attached to the carrier housing when the control element is in the initial actuation position.

If there is a risk that the arc section of the actuation projection of the control element loses contact with the contact point of the functional element as a result of the gearing lag of the drive device, an emergency stopping of the drive device is necessary. For this, the invention provides in a further design that a trigger element is formed on the drive shaft, offset on the circumference to the actuation projection and axially offset to the trigger projection, which actuates a switch attached to the carrier housing when the control element is in the final actuation position.

To implement the emergency stop property of the trigger element, it is advantageous when the trigger projection and the trigger element extend radially from the drive shaft with identical radii, wherein the trigger projection and the trigger element are each arc-shaped, with a respective arc, and wherein the arc of the trigger projection is longer than the arc of the trigger element.

For a compact construction, it is advantageous in the design of the invention, when the arc of the trigger element is disposed such that it lies along its circumference within the arc of the trigger projection when seen from the side.

The invention relates in general to functional elements of motor vehicles, e.g. rear view cameras or door handles, that are to be moved and extended from a recessed or flush position to an exposed position in order to exercise their function. In this regard, the invention provides in its design that the functional element is a motor vehicle door handle, which has a handle and at least one pivot arm, rotatably supported on the carrier housing, to which the handle is attached. The invention therefore also comprises a motor vehicle door handle assembly, which has a carrier housing that can be attached to a motor vehicle, a handle, which is supported via at least one pivot arm on the carrier housing such that it can rotate about a rotational axis and can be moved between a standby position and an operating position, a drive device disposed on the carrier housing, and a control element in a drive connection with the drive device, which is designed to move the handle from the standby position into the operating position when the drive device is activated, wherein the control element moves from a home position into a final actuation position via an initial actuation position when the drive device is activated, wherein the control element forces the handle from the standby position into the operating position when it moves from the home position into the initial actuation position, and wherein the control element retains the handle in the operating position when it moves from the initial actuation position into the final actuation position.

As a matter of course, the features specified above and still to be explained below can be implemented not only in the respective given combinations, but also in other combinations, or in and of themselves, without abandoning the scope of the present invention. The scope of the invention is defined only by the claims.

BRIEF DESCRIPTION OF THE DRAWINGS

Further details, features, and advantages of the subject matter of the invention can be derived from the following description in conjunction with the drawings, in which advantageous and preferred exemplary embodiments of the invention are depicted. Therein.

DETAILED DESCRIPTION

Figure 1:
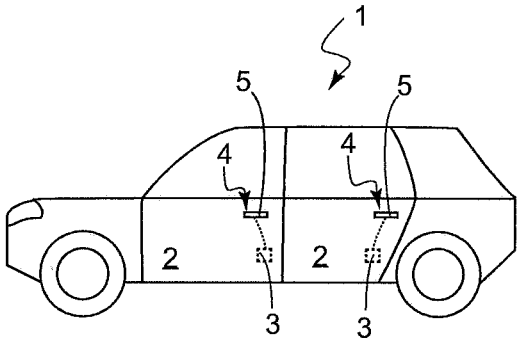
FIG. 1 shows a side view of a motor vehicle with a schematically illustrated motor vehicle actuation device in accordance with the invention.

An exemplary depiction of a motor vehicle 1 in the form of a passenger car is shown in FIG. 1, which has four doors 2 (two of which are shown in FIG. 1) in the example. The doors 2 can be locked via respective motor vehicle locks 3, and can be unlocked using a motor vehicle actuation device 4, merely indicated by way of example in FIG. 1, in that a user actuates a functional element 5 of the motor vehicle actuation device 4 designed as a handle.

Figure 2:
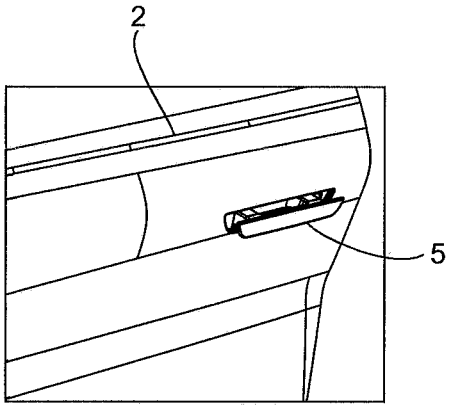
FIG. 2 shows a perspective view of a door of the motor vehicle with the motor vehicle actuation device according to the invention.

FIG. 2 shows a perspective view of the door 2, in which the functional element 5 protrudes out of the door 2. The functional element 5 is a handle 5*a*, which is flush with the door 2 in the unactuated stated, attached to pivot arms 7, such that the handle is recessed in the door 2 when not in use.

Figure 3:
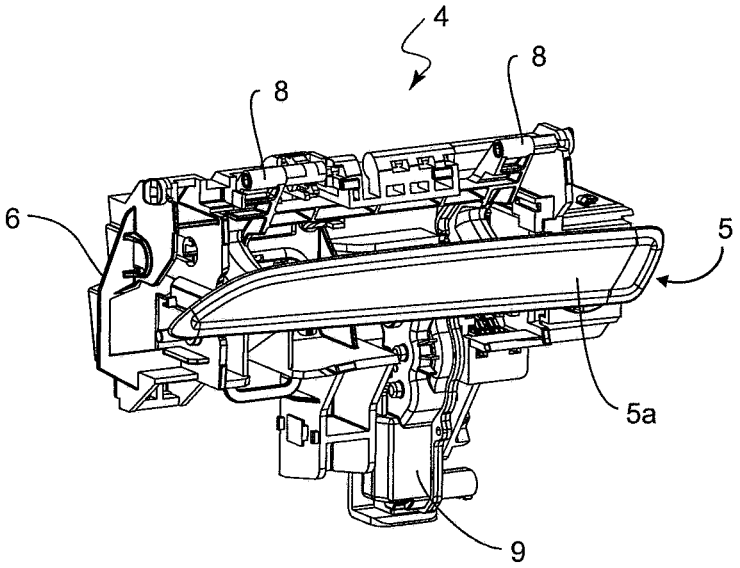
FIG. 3 shows a perspective view of the motor vehicle actuation device.

A perspective view of the motor vehicle actuation device 4 is shown in FIG. 3. The motor vehicle actuation device 4 comprises a carrier housing 6, which is attached on the inside of the door 2, and on which the functional element 5, comprising the handle 5*a* and the pivot arms 7, is supported in the exemplary embodiment. The functional element 5, or the handle 5*a*, however, is not rotatably supported directly on the carrier housing 6 in the exemplary embodiment shown therein, but instead via two pivot arms 7. The handle 5*a* is consequently attached to one end of the pivot arm 7, wherein the other end of the pivot arm 7 is supported such that it can rotate about a rotational axis 8 on the carrier housing 6, such that on the whole, the functional element 5, or the handle 5*a* is supported on the carrier housing 6 such that it can rotate about the rotational axis 8. The rotational axis 8 is divided thereby, meaning that the two pivot arms 6 are supported at their corresponding longitudinal ends such that they can rotate about respective rotational axes 8, or points of rotation on the carrier housing 6. The functional element 5 in the form of the handle 5*a* can move thereby between a standby position, in which the handle 5*a* is flush with the outer contour of the door 2, and an operating position (see FIG. 2), in which the handle 5*a* can be actuated by a user in order to open the door. The approach of an authorized user, whose ID transponder is detected by a sensor system in the known manner, is sufficient to cause the handle 5*a* to extend outward from the outer contour of the door 2, at which point a drive device 9, shown in greater detail in FIG. 4, is activated, which is responsible for the movement of the functional element 5, or the handle 5*a*.

Figure 4:
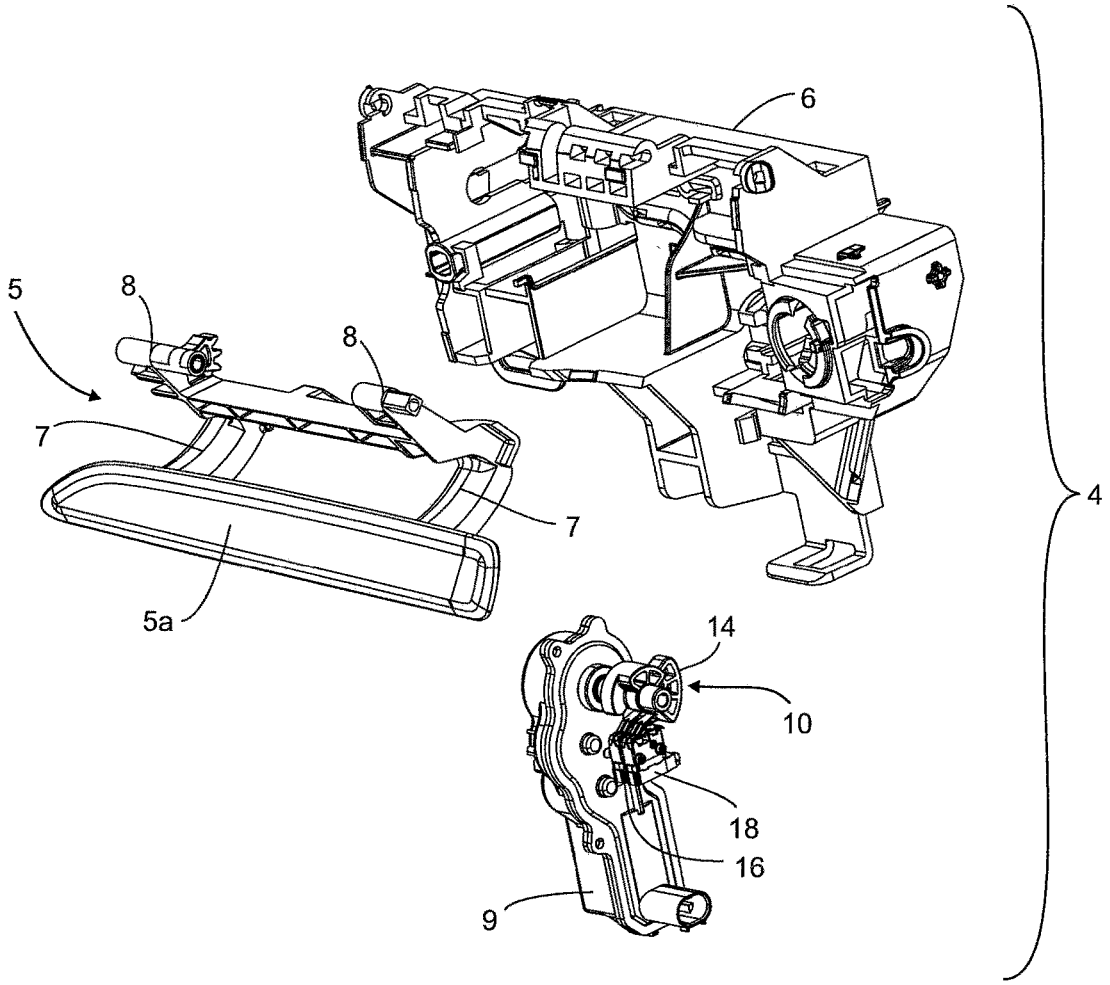
FIG. 4 shows a perspective exploded illustration of the motor vehicle actuation device in FIG. 3.

The motor vehicle actuation device, which is designed as a motor vehicle door handle assembly in the exemplary embodiment, can be seen in an exploded illustration in FIG. 4. In addition to the carrier housing 6, the motor vehicle actuation device 4 comprises the functional element 5 in the form of the handle 5*a*, the drive device 9 attached to the carrier housing 6, and a control element 10 in a drive connection with the drive device 9.

When activated, the drive device 9 moves the functional element 5, or the handle 5*a*, out of the standby position, shown in FIGS. 7 to 12, to the operating position, shown in FIGS. 1 to 18. For this, the activated drive device 9 moves the control element 10 from a home position, shown in FIGS. 7 to 9, via an engagement position, shown in FIGS. 10 to 12, and via an initial actuation position, shown in FIGS. 13 to 15, into a final actuation position, shown in FIGS. 16 to 18. Before describing the individual movement steps in greater detail on the basis of the figures, however, structural details of the motor vehicle actuation device 4 shall be explained.

Figure 5:
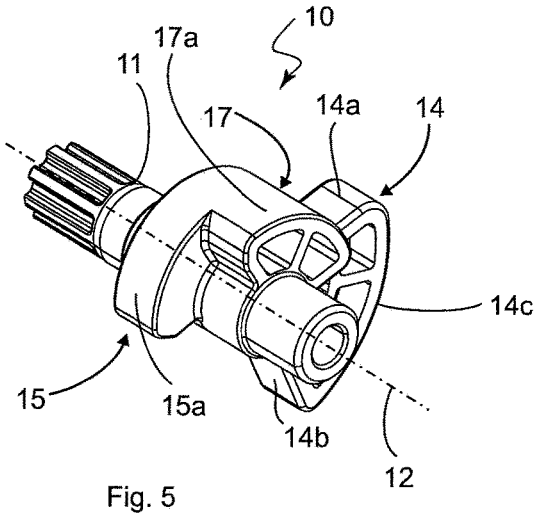
FIG. 5 shows a perspective illustration of a control element of the motor vehicle actuation device in FIG. 4.
Figure 6:
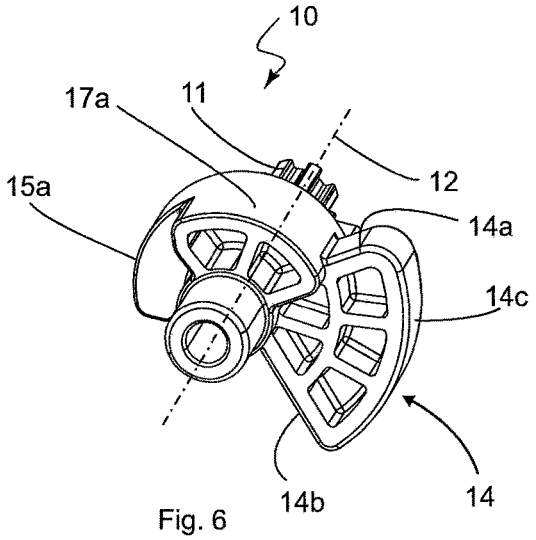
FIG. 6 shows another perspective illustration of the control element in FIG. 4.

As can be seen from FIGS. 4 to 6 when viewed collectively, the control element 10 has a drive shaft 11 in a drive connection with the drive device 9, which is permanently connected to a drive of the drive device 9, not shown in greater detail, such that the drive device 9 rotates the drive shaft 11 about its longitudinal axis 12 when activated. An actuation projection 14 is formed on the drive shaft 11, extending radially away from the drive shaft 11. The actuation projection 14 is in the form of a cam, and designed as an axial section of the drive shaft 11 that has an irregular circumference. When the control element 10 moves into the initial actuation position, the actuation projection 14 interacts with the functional element 5 and forces the functional element 5 out of the standby position into the operating position. FIGS. 5 and 6 show various views of the control element 10, from which it can be seen that the actuation projection 14 is arc-shaped when regarded axially. The arc of the actuation projection 14 of the control element 10 is defined by two radius line sections 14*a* and 14*b* and by an arc section 14*c*. Furthermore, a trigger projection 15 is formed on the drive shaft 11, which is offset to the actuation projection 14 over the circumference. When the activated control element 10 is in its initial actuation position, the trigger projection 15 actuates a button 16 attached to the carrier housing 6. Lastly, a trigger element 17 is formed on the drive shaft 11, which is offset to the actuation projection 14 over the circumference, and is axially offset to the trigger projection 15. When the activated control element 10 is in its final actuation position, the trigger element 17 actuates a switch 18, which is attached to the carrier housing. Like the actuation projection, the trigger projection 15 and the trigger element 17 also extend radially from drive shaft 11, wherein the radius of the trigger projection 15 and the radius of the trigger element 17 are of equal length. The trigger projection 15 and the trigger element 17 are each arc-shaped, having respective arcs 15*a* and 17*a*, wherein the arc 15*a* of the trigger projection 15 is longer than the arc 17*a* of the trigger element 17. Consequently, the arc 17*a* of the trigger element 17 is disposed along its circumference within the arc 15*a* of the trigger projection 15 when seen from the side (see FIG. 6, by way of example). Because the trigger projection 15 is formed directly axially adjacent to the trigger element 17 on the drive shaft 11, and both have the same radius, the arc 17*a* of the trigger element 17 transitions into the arc 15*a* of the trigger projection 15.

The functioning of the motor vehicle actuation device 4 according to the invention shall be described below in the basis of FIGS. 7 to 18.

Figure 7:
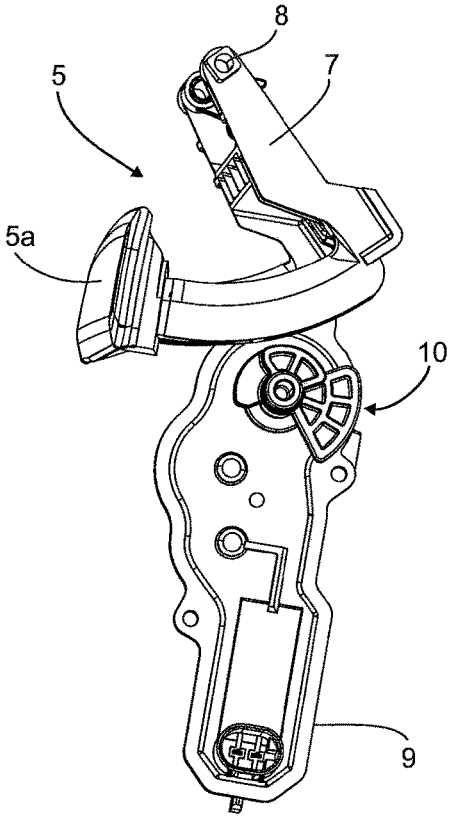
FIG. 7 shows a side view of the motor vehicle actuation device, in which the control element is in a home position, and a functional element of the motor vehicle is in a standby position.
Figure 8:
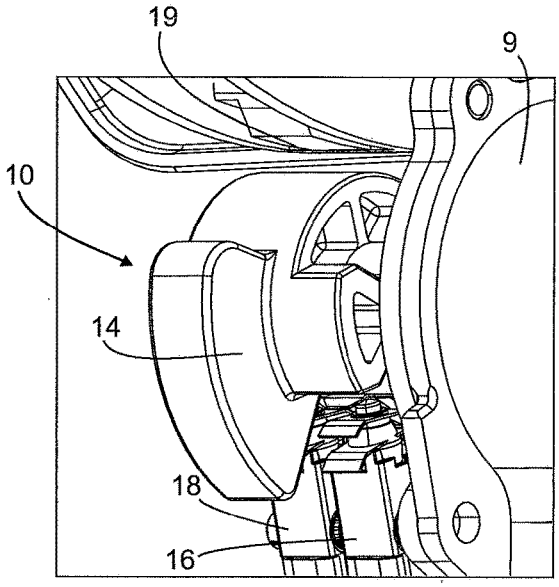
FIG. 8 shows an enlarged view of the control element in its home position.
Figure 9:
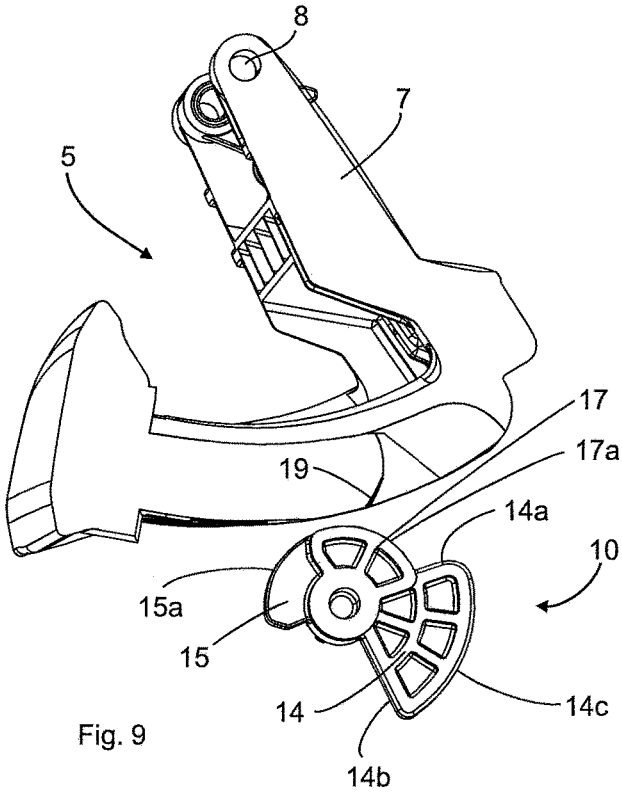
FIG. 9 shows a cutaway side view of the control element and the functional element in FIG. 7.

The functional element 5 in the form of the handle 5*a* is in the standby position in FIGS. 7 to 9. Neither the drive device 9 nor the motor vehicle actuation device 4 are activated thereby, such that the control element 10 is in its home position. In the home position, the actuation projection 14 of the control element is at a spacing to a contact point 19 (see FIG. 9, by way of example), such that it is not in contact therewith. The activated control element 10 engages with the contact point 19, which is formed on the functional element 5, or on one of the two pivot arms 7, in order to move the functional element 5 out of its standby position. The contact point 19, or the contact section, is formed in a recess in the pivot arm 7, and can thus only be seen in the sectional view in FIG. 9 (and FIGS. 12, 15 and 18). When the control element 10 is in the home position, the button 15 and the switch 18 are not actuated.

Figure 10:
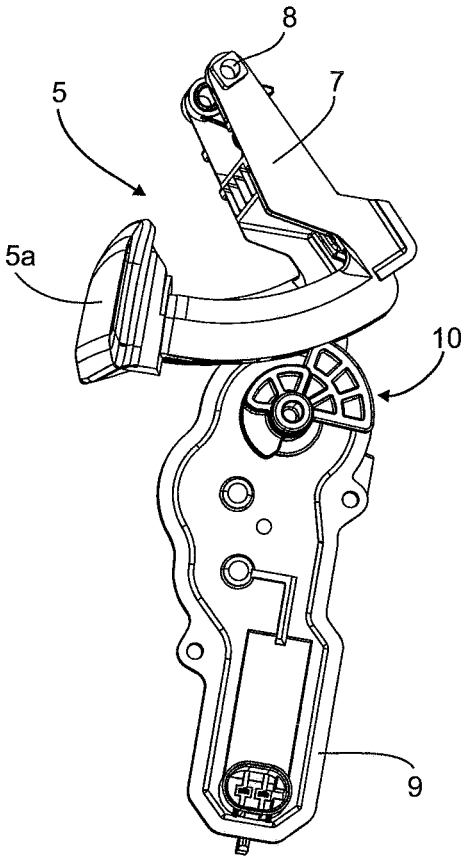
FIG. 10 shows a side view of the motor vehicle actuation device, in which the control element is in an engagement position, and the functional element is in the standby position.
Figure 11:
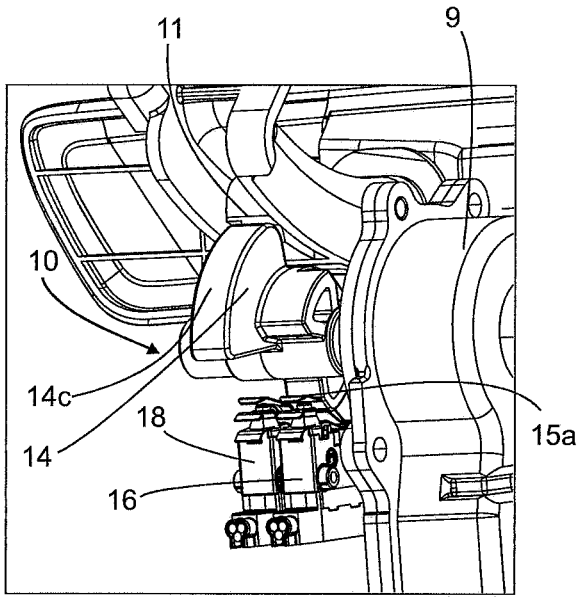
FIG. 11 shows an enlarged view of the control element in its engagement position.
Figure 12:
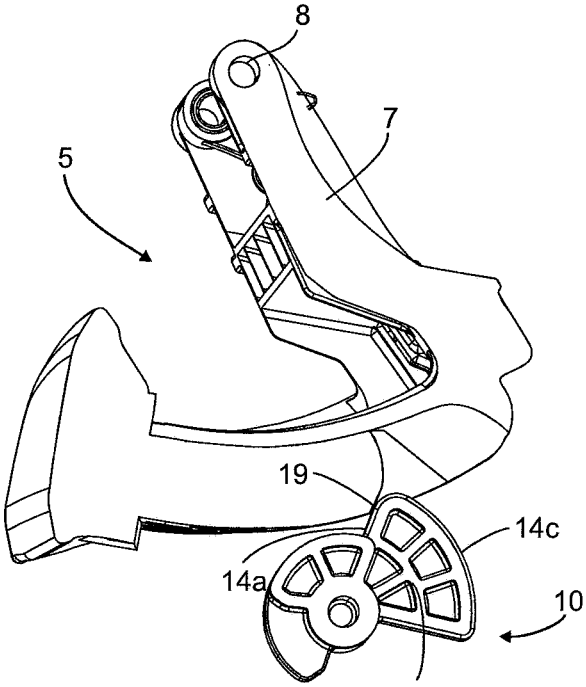
FIG. 12 shows a cutaway side view of the control element and the functional element in FIG. 10.

FIGS. 10 to 12 shown an assembly in which the functional element 5, or the handle 5*a*, is still in the standby position. The motor vehicle actuation device 4 is activated, however, because the approach of an authorized user has been detected, at which point the then activated drive device 9 moves the functional element 5 into its engagement position. As a result, the drive device 9 is activated, and it rotates the drive shaft 11 about its longitudinal axis 12, in a counter-clockwise direction in FIGS. 10 to 12. When in the engagement position, the radius line section 14*a* of the actuation projection 14 on the control element 10 bears on the contact point 19. The contact point 19 is offset to the rotational axis 8, such that when the control element moves further, the functional element 5 in the form of the handle 5*a* is pivoted about the rotational axis 8. When the control element 10 is in the engagement position, the button 15 and the switch 18 remain unactuated, as can be seen in FIG. 11.

Figure 13:
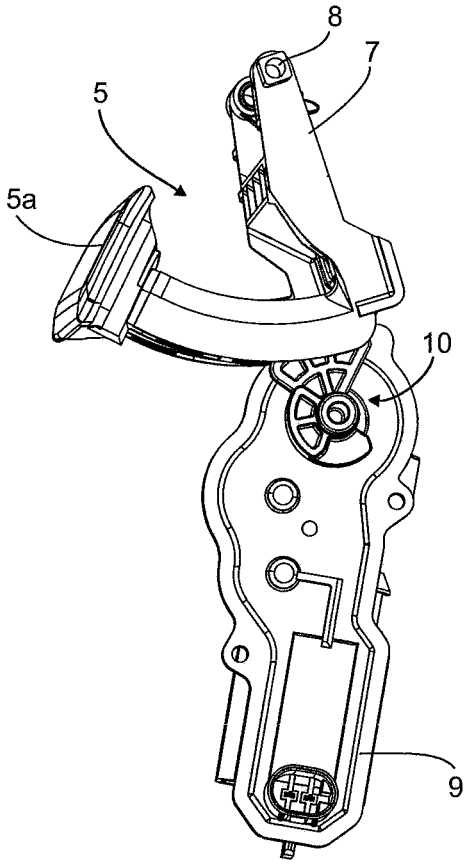
FIG. 13 shows a side view of the motor vehicle actuation device, in which the control element is in an initial actuation position, and the functional element is in an operating position.
Figure 14:
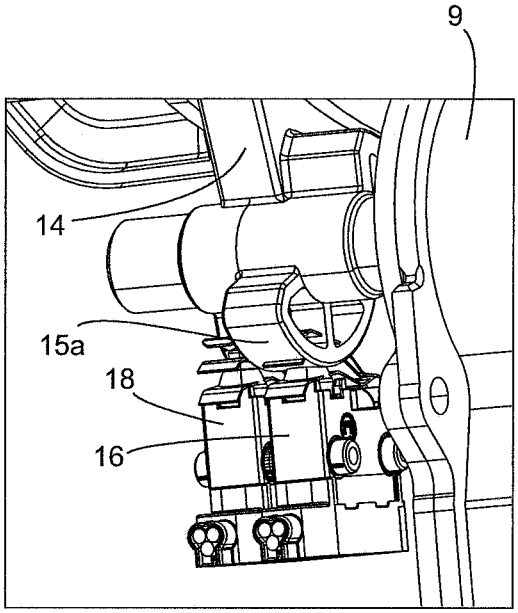
FIG. 14 shows an enlarged view of the control element in its initial actuation position.
Figure 15:
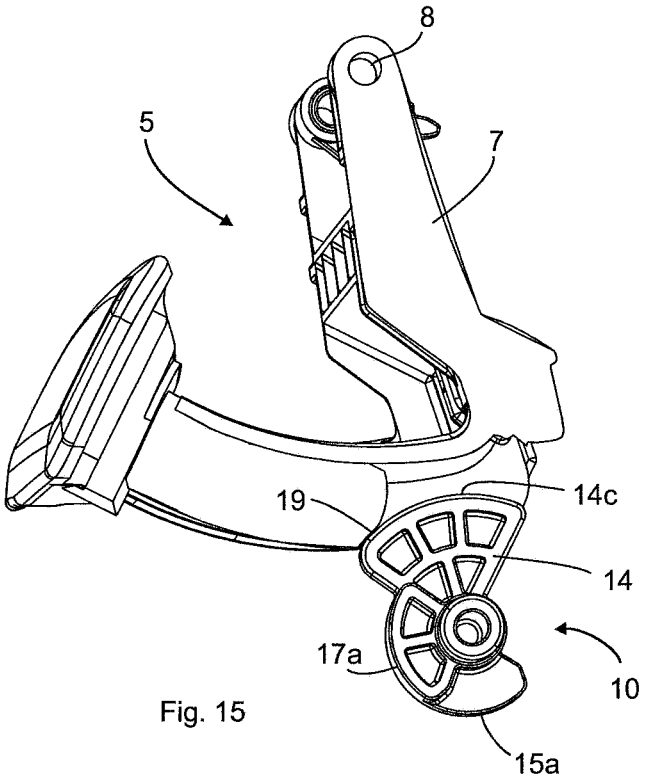
FIG. 15 shows a cutaway side view of the control element and the functional element in FIG. 13.

Furthermore, a situation is shown in FIGS. 13 to 14, in which the functional element 5, i.e. the handle 5*a*, is moved out of its standby position, and into its operating position. The control element 10 is rotated further by the drive device 9, in a counter-clockwise direction, about the longitudinal axis 12, and then disposed in the initial actuation position. When the drive device 9 is activated, it thus moves the control element 10 from the home position into the initial actuation position via the engagement position. When moving into the initial actuation position, the control element 10 forces the functional element 5, thus the handle 5*a*, into the operating position, in that it pivots the functional element 5 about the rotational axis 8. When in the initial actuation position, the arc 14*c* of the actuation projection 14 bears in part on the contact point 19, as can be seen in FIG. 15. When in the initial actuation position, the trigger projection 15 actuates the control element 10 of the button 16 (see FIG. 14), such that the drive device 9 can be stopped, because the functional element 5 has reached the desired operating position. The switch 18 remains unactuated thereby.

Figure 16:
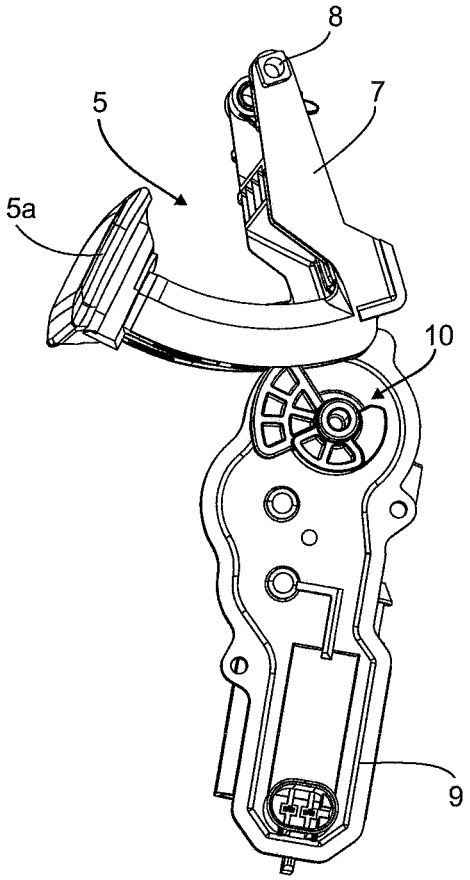
FIG. 16 shows a side view of the motor vehicle actuation device, in which the control element is in a final actuation position, and the functional element in the operating position.
Figure 17:
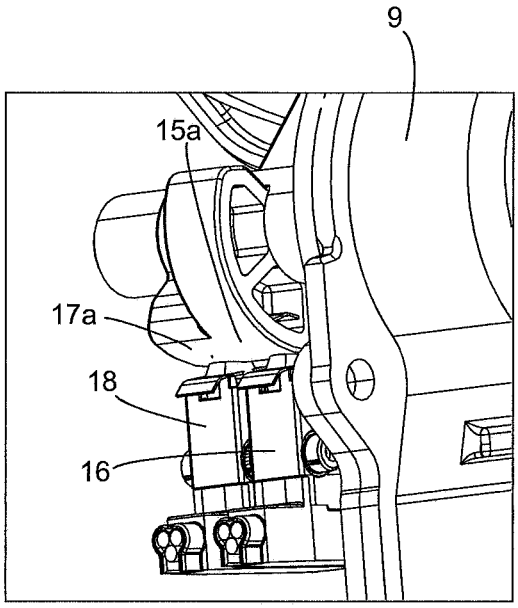
FIG. 17 shows an enlarged view of the control element in its final actuation position.
Figure 18:
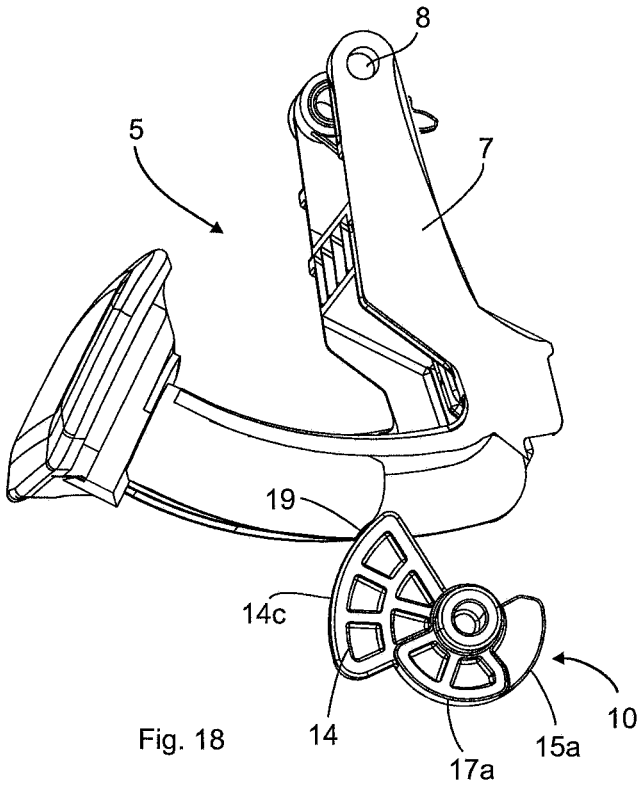
FIG. 18 shows a cutaway side view of the control element and the functional element in FIG. 16.

As can be seen lastly in FIGS. 16 to 18, the functional element 5 in the form of the handle 5*a* is disposed in the operating position, while the drive device 9 of the control element 10 has rotated further about the longitudinal axis 12, such that the control element 10 is then in the final actuation position, in which the arc 14*c* of the actuation projection 14 continues to bear in part on the contact point 19 formed on the functional element 5. When the control element 10 moves out of the initial actuation position into the final actuation position, the arc 14*c* of the functional element 5 bears in part on the contact point 19, thus retaining the functional element 5 in the operating position. When in the final actuation position, the arc 17*a* of the trigger element 17 actuates the switch 18, wherein the button 16 remains actuated by the arc 15*a* of the trigger projection 15 (see FIG. 17). Because both the button 16 and the switch 18 are actuated, the drive device 9 is stopped by this point, in order for the arc 14*c* of the actuation projection 14 to retain the functional element 5 in the operating position.

The invention described above for a door handle assembly of a motor vehicle relates in general to functional elements of motor vehicles, e.g. rear view cameras or motor vehicle door handles in general, that are to be extended from a recessed or flush position into an exposed position in order to exercise their function, and be actuated, if applicable. In particular, functional element in the invention is a motor vehicle door handle, which has a handle, and at least one pivot arm rotatably supported on the carrier housing, to which the handle is attached. Consequently, the invention also comprises a motor vehicle door handle assembly that has a carrier housing that can be attached to a motor vehicle, a handle, which is supported via at least one pivot arm on the carrier housing, such that it can rotate about a rotational axis and move between a standby position and an operating position, a drive device disposed on the carrier housing, and a control element in a drive connection with the drive device, which is configured to move the handle from the standby position into the operating position when the drive device is activated, wherein, when the drive device is activated, the control element moves from a home position into a final actuation position via an initial actuation position, wherein the control element forces the handle from the standby position into the operating position when it moves from the home position into the initial actuation position, and wherein the control element retains the handle in the operating position when it moves from the initial actuation position into the final actuation position.

As a matter of course, the invention described above is not limited to the embodiments described and illustrated herein. It is clear that numerous modifications corresponding to the intended use, obvious to the person skilled in the art, may be made to the embodiments shown in the drawings, without abandoning the field of the invention thereby. Everything contained in the description and/or shown in the drawings belongs to the invention, including that deviating from the concrete exemplary embodiments, which is obvious to the person skilled in the art.

The invention claimed is:

1. A motor vehicle actuation device, including a carrier housing that can be attached to a motor vehicle, a functional element, which is supported on the carrier housing such that it can rotate about a rotational axis and be moved between a standby position and an operating position, a drive device disposed on the carrier housing, and a control element in a drive connection with the drive device, which is designed to move the functional element from the standby position into the operating position when the drive device is activated, wherein the control element is moved from a home position into a final actuation position via an initial actuation position when the drive device is activated, wherein the control element forces the functional element from the standby position into the operating position when it moves from the home position into the initial actuation position, and wherein the control element retains the functional element in the operating position when it moves from the initial actuation position into the final actuation position.

2. The motor vehicle actuation device according to claim 1, wherein the control element has a drive shaft in a drive connection with the drive device, on which an actuation projection is formed, projecting radially away from the drive shaft, which interacts with the functional element when the control element moves into the initial actuation position, and forces the functional element from the standby position into the operating position.

3. The motor vehicle actuation device according to claim 2, wherein the actuation projection is arc-shaped, when seen axially, with two radius line sections and an arc section, wherein the control element moves from its home position into the initial actuation position via an engagement position when the drive device is activated, wherein when in the home position, the actuation projection is disposed at a spacing to a contact point and without contact therewith, wherein the contact point is formed on the functional element and offset to the rotational axis, and wherein one of the two radius line sections of the actuation projection bears on the contact point when the control element is in the engagement position.

4. The motor vehicle actuation device according to claim 3, wherein the arc section of the actuation projection bears on the contact point when the control element is in the initial actuation position.

5. The motor vehicle actuation device according to claim 3, wherein when the drive device is activated, the arc section of the actuation projection bears on the contact point when the control element moves from its initial actuation position into its final actuation position.

6. The motor vehicle actuation device according to claim 2, wherein a trigger projection is formed on the drive shaft, wherein the trigger projection is displaced in relation to a circumferential position of the actuation projection, wherein the trigger projection actuates a switch attached to the carrier housing when the control element is in the initial actuation position.

7. The motor vehicle actuation device according to claim 6, wherein a trigger element is formed on the drive shaft, wherein the trigger element is displaced in relation to the circumferential position of the actuation projection, and wherein the trigger element is axially offset to the trigger projection, wherein the trigger element actuates a switch attached to the carrier housing when the control element is in the final actuation position.

8. The motor vehicle actuation device according to claim 7, wherein the trigger projection and the trigger element extend radially from the drive shaft with identical radii, wherein the trigger projection and the trigger element are each arc-shaped, having a respective arc section, and wherein the arc section of the trigger projection is longer than the arc section of the trigger element.

9. The motor vehicle actuation device according to claim 8, wherein the arc section of the trigger element lies with a circumference of the arc section of the trigger element inside the arc section of the trigger projection when seen from the side.

10. The motor vehicle actuation device according to claim 1, wherein the functional element comprises a motor vehicle door handle, which includes a handle member and at least one pivot arm rotatably supported on the carrier housing, on which the handle member is attached.

* * * * *